US012185778B2

(12) United States Patent
Moore

(10) Patent No.: US 12,185,778 B2
(45) Date of Patent: Jan. 7, 2025

(54) DYNAMIC PULLOVER TOP

(71) Applicant: James T. Moore, Wilmington, NC (US)

(72) Inventor: James T. Moore, Wilmington, NC (US)

( * ) Notice: Subject to any disclaimer, the term of this patent is extended or adjusted under 35 U.S.C. 154(b) by 10 days.

(21) Appl. No.: 15/692,453

(22) Filed: Aug. 31, 2017

(65) Prior Publication Data

US 2017/0360129 A1 Dec. 21, 2017

Related U.S. Application Data

(63) Continuation-in-part of application No. 14/458,230, filed on Aug. 12, 2014, now abandoned.
(Continued)

(51) Int. Cl.
*A41D 27/08* (2006.01)
*A41B 1/10* (2006.01)
(Continued)

(52) U.S. Cl.
CPC ..... *A41D 27/08* (2013.01); *A41B 1/10* (2013.01); *A41D 3/005* (2013.01); *A41F 1/002* (2013.01)

(58) Field of Classification Search
CPC .... A41B 1/00; A41B 1/06; A41B 1/18; A41B 1/10; A41D 3/005; A41D 27/00;
(Continued)

(56) References Cited

U.S. PATENT DOCUMENTS 308,244 A * 11/1884 Fishel ..... A41D 27/28 2/119
339,406 A * 4/1886 Halsted ..... A41D 1/22 2/105

(Continued)

FOREIGN PATENT DOCUMENTS

WO WO 03077690 A1 * 9/2003

OTHER PUBLICATIONS

YBMW, All things geek. Est. 2008, "Quite Possibly The Classiest Geek Wedding Ever", Oct. 11, 2010), https://youbentmywookie.com/wtf/quite-possibly-the-classiest-geek-wedding-ever-10317, pp. 1-2. (Year: 2010).*

(Continued)

*Primary Examiner* — Heather Mangine
*Assistant Examiner* — Raquel M. Weis
(74) *Attorney, Agent, or Firm* — David S. Bradin; Maynard Nexsen PC

(57) ABSTRACT

A pullover-style shirt, the shirt comprising an exterior layer of fabric, an interior layer of fabric, an aperture in the exterior layer, securing means that serve to close the aperture when the aperture is not actively manipulated by a user, but that allow the easy opening of the aperture to display the interior layer when the aperture is actively manipulated by a user. The inventor contemplates that the interior layer should bear a graphic display that is exposed when the aperture is opened. The securing means are to be a system of opposite polarity magnets that sewn into the edges of the aperture, thus closing the aperture via their force of attraction when not restrained from one another. Still further, the inventor expressly contemplates that the aperture should be positioned so as to locate over the sternum of a user when the pullover top is worn.

1 Claim, 5 Drawing Sheets

Related U.S. Application Data

(60) Provisional application No. 61/864,642, filed on Aug. 12, 2013.

(51) Int. Cl.
*A41D 3/00* (2006.01)
*A41F 1/00* (2006.01)

(58) Field of Classification Search
CPC ..... A41D 27/08; A41D 1/205; A41D 1/215; A41D 1/04; A41D 1/21; A41D 1/22; A41D 13/0158; A41D 27/02; A41D 27/285
See application file for complete search history.

(56) References Cited

U.S. PATENT DOCUMENTS 383,550 A * 5/1888 Woolf ..... A41D 1/22 2/105
862,491 A * 8/1907 Lowe ..... A41D 1/22 2/105
1,250,464 A * 12/1917 Janes ..... A41D 1/215 2/104
1,707,441 A * 4/1929 Levinson ..... A41D 1/04 2/90
1,906,912 A * 5/1933 Lockwood ..... A41B 1/02 2/106
2,051,482 A 8/1936 Bernard
2,301,527 A * 11/1942 English ..... A41D 27/04 2/97
2,728,080 A * 12/1955 Beard ..... A41B 9/06 2/113
2,786,207 A 3/1957 Abraham
2,911,650 A * 11/1959 Gerich ..... A41D 1/215 2/104
3,370,303 A * 2/1968 Tempelhof ..... A41D 3/04 2/87
4,296,498 A * 10/1981 Vinson ..... A41D 1/04 2/115
4,566,136 A * 1/1986 Echols ..... A41D 1/215 2/104
4,608,715 A * 9/1986 Miller ..... A41D 27/285 2/87
4,710,981 A 12/1987 Sanchez
4,713,842 A * 12/1987 Patterson ..... A41D 1/215 2/104
4,809,626 A * 3/1989 Tyner ..... A41B 1/18 2/103
4,813,081 A * 3/1989 Cliff ..... A41D 1/04 2/244
4,843,647 A * 7/1989 Phillips, Sr. ..... A47G 9/086 2/93
4,999,850 A * 3/1991 Grilliot ..... A41D 13/00 2/126
5,133,086 A * 7/1992 Truitt ..... A41D 13/1236 2/105
5,182,813 A * 2/1993 Booze ..... A41D 1/215 2/104
5,361,523 A * 11/1994 Robinson ..... A41D 27/08 40/586
5,398,343 A * 3/1995 Kuracina ..... A41D 27/28 40/586
5,544,365 A * 8/1996 Mondy ..... A41D 27/08 2/69
5,727,256 A * 3/1998 Rudman ..... A41D 27/28 2/DIG. 1
5,752,277 A * 5/1998 van der Sleesen .... A41D 27/28 2/108
6,044,492 A 4/2000 Krogh
6,125,472 A * 10/2000 Nakagawa ..... A45C 13/08 2/DIG. 1
6,175,960 B1 * 1/2001 Knittel ..... A41D 27/08 40/586
6,199,210 B1 * 3/2001 Feldman ..... A41D 27/08 2/244
6,216,270 B1 * 4/2001 Moquin ..... A41D 13/1245 2/114
6,405,377 B1 * 6/2002 Davis ..... A41D 15/04 2/108
6,684,408 B2 * 2/2004 Rindle ..... A41D 3/00 2/108
6,941,584 B1 * 9/2005 Matthews ..... A41D 13/02 2/234
7,412,728 B2 * 8/2008 Alesina ..... A41D 27/28 2/93
7,437,774 B2 * 10/2008 Baron ..... D03D 15/50 2/DIG. 2
7,810,171 B2 * 10/2010 Moore ..... A41D 1/215 2/104
8,001,618 B2 * 8/2011 Bay ..... A41D 27/28 2/96
8,276,213 B2 10/2012 Maurer
10,413,000 B1 * 9/2019 Reeves ..... A41D 1/06
2005/0204449 A1 * 9/2005 Baron ..... D03D 15/49 2/69
2006/0041990 A1 * 3/2006 Alesina ..... A41D 27/28 2/93
2006/0059601 A1 * 3/2006 Opitz ..... A41D 27/00 2/108
2008/0289078 A1 * 11/2008 Mather ..... A41D 13/0015 2/243.1
2009/0178174 A1 * 7/2009 Cash, Jr. ..... A41D 27/28 2/243.1
2009/0178245 A1 7/2009 Albert
2010/0005694 A1 * 1/2010 Forte ..... A47G 1/0616 40/757
2010/0095424 A1 * 4/2010 Grgich ..... A41D 1/215 2/104
2010/0186134 A1 * 7/2010 Hunter ..... B32B 27/12 2/2.5
2010/0192276 A1 * 8/2010 Anderson ..... A41D 1/04 2/69
2014/0130233 A1 * 5/2014 Horton ..... A41B 1/10 2/123
2017/0006937 A1 * 1/2017 Wu ..... A41D 13/1245
2017/0245558 A1 * 8/2017 Smith ..... A41D 27/08

OTHER PUBLICATIONS

IMDb, Spider-Man, 2002, file:///C:/Users/bszafran/Documents/e-Red%20Folder/15692453/Spider-Man%20(2002)%20-%20IMDb.pdf (Year: 2002).*
Milkshirt Breastfeeding and Nursing Undershirt, Nov. 25, 2011, https://web.archive.org/web/20111125035508/http://www.selfexpressions.com/milkshirt.html, p. 1 (Year: 2011).*

* cited by examiner

DYNAMIC PULLOVER TOP

CROSS-REFERENCE TO RELATED APPLICATIONS

This application is a continuation of U.S. Ser. No. 14/458,230, filed on Aug. 12, 2014, which in turn claims priority to U.S. Provisional No. 61/864,642, filed on Aug. 12, 2013. The contents of these applications are incorporated herein by reference in their entirety for all purposes.

BACKGROUND OF THE INVENTION

(a) Field of the Invention

The present invention is in the technical field of clothing and apparel. More particularly, the present invention is in the technical field of shirts, tops and other clothing that might be worn by a user to cover the user's torso. Even more particularly, the present invention is in the technical field of novelty clothing and apparel and novelty shirts and tops.

(b) Background Art

Articles of clothing are frequently tailored for specific functional purposes in specific contemplated contexts (i.e., raincoats, jogging pants, sports bras, etc.), for specific aesthetic or fashion purposes (i.e., graphic print t-shirts, designer jeans, etc.), or for both of these purposes (i.e., graphic print moisture-wicking shirts, logo-imprinted hats, etc.). In the latter two contexts, the prior art suffers from an inability for any single article of clothing to present more than a single visual presentation to an audience. By way of example, if a t-shirt is screen-printed with a picture of a dog, that particular t-shirt will always be displayed inflexibly with the image of that particular dog and a user has no ability to dynamically change the graphic presentment on the face of the t-shirt without permanently printing or stitching over top of the dog image, or otherwise buying a new t-shirt with a different static image. More specifically, the prior art suffers from a dearth of novelty clothing articles that enable a user to manipulate the article in real time to change what a third-party viewer may perceive as the aesthetic of the clothing article. While few and far between, one method of accomplishing the goal of such a dynamic novelty clothing article has been the introduction of multi-layers articles featuring apertures in an exterior layer and allowing two views of the aesthetic of the article—a first being a design, message or graphic displayed across the exterior layer of fabric and across the closed aperture, and a second being a design, message or graphic displayed across an interior layer of fabric and only visible when the aperture is opened.

Articles of clothing featuring designed apertures that may be interchangeably opened and closed are known in the existing art. For instance, United States patent application publication US 2009/0178174 A1 published on Jul. 19, 2009 to inventor Cash (the "Cash reference") discloses an apertured pant designed for the functional purpose of allowing a wearer to vent the legs of the pant and release trapped body heat without having the inconvenience of removing and carrying the pant legs separately. The Cash reference specifically contemplates that the disclosed pant is comprised of two layers of fabric, a first exterior layer exposed to the elements, and a second interior "modesty layer" intended to obstruct the view of third-parties vis-a-vis the anatomy of the user beneath the pant.

While the Cash reference invention no doubt serves its functional purpose of venting and thereby cooling the legs of a user, there is no suggestion from the Cash reference that the apertured pant may have an analog in an aperture top or pullover and there is no contemplation that the second interior "modesty layer" should have any function other than to deter and obstruct the vision of third-parties, as opposed to being a decorative portion of the garment with the intent being that third-party bystanders actively pay attention to design and messages contained on the surface of the interior layer. An article of clothing, particularly a top, that features the aperture and the interior layer of fabric as a decorative feature of the article is therefore a desirable improvement over this prior art.

Similarly, novelty clothing articles having hidden designs contained within the garment are known in the existing art. U.S. Pat. No. 5,544,365 issued on Aug. 13, 1996 to inventor Mondy (the "Mondy reference") discloses a novelty clothing article having a flexible three-dimensional display member that extends from a pocket in the article when the pocket is opened. Specifically, the Mondy reference contemplates that the display aspect of the clothing article is formed of a flexible, resilient material that is capable, when released, of re-assuming a predetermined configurations to provide a three-dimensional display.

While the Mondy reference contemplates a clothing article, specifically a top, having an aperture through which a hidden design is viewable when the aperture is opened, Mondy limits its disclosure to a "resilient compressible display member having a predetermined extended configuration" that remains compressed within the pocket formed by the closing of the aperture until such time that the aperture is opened. The result is a noticeable lump in the article of clothing caused by the resilient compressible display pressing itself against the interior of the closed aperture, adding unnecessary weight and bulk to the article of clothing and thereby sacrificing comfort for novelty. Furthermore, the Mondy reference expressly contemplates that the aperture is opened and closed by means of a zipper assembly, a method that could prove cumbersome and awkward in showcasing the novelty feature of the clothing article as the user must secure the article of clothing above the zipper with a first hand, pull the zipper down unzipping the aperture with a second hand and allowing the 3-D display to fully extend from the aperture, then awkwardly tuck the 3-D display back into the aperture and attempt to hold the display in place while pulling the zipper back up to close the aperture and aperture pocket—it is hard to imagine this method being more enjoyable than annoying to a user.

Further demonstrating the breadth of prior art known in the novelty clothing article technical field is U.S. Pat. No. 6,125,472 issued on Oct. 3, 2000 to inventor Nakagawa (the "Nakagawa reference"). The invention of the Nakagawa reference contemplates clothing, headgear, or accessories comprising a surface having a plurality of linear cuts forming openings lined with back covers that are exposed when the linear cuts are open. The linear cuts are further coupled with any of several traditional fasteners, including but not limited to zippers, snap-fasteners, hooks and the like. The back covers cited in the Nakagawa reference are specifically adorned with the attributes of a face, including eyes and mouth, and the overall effect of the novelty article is to be the appearance of a face.

The Nakagawa reference has shortcomings in its reliance upon crude traditional fastening systems that must be manipulated by a user twice to accomplish a display and then subsequent concealment of the design, message or graphic hidden within the apertures in the clothing. A zipper must be unzipped and then zipped to display and conceal the back covers within and behind the apertures. A snap-fastener must be unsnapped and then snapped to display and conceal the back covers within and behind the apertures. A hook fastening apparatus must be unhooked and then hooked to display and conceal the back covers within and behind the apertures. Further, as contemplated by the Nakagawa reference, the back covers are static images, not interchangeable at a user's election.

Accordingly and in view of the known prior art, there remains a need for a novelty clothing article, specifically a pullover top, that features at least a single aperture that may be opened or closed to display or conceal a design, message or graphic of a user's choosing to a viewing audience. Further, there remains a need for a novelty clothing article, specifically a pullover top, that features at least a single aperture coupled with means for securing the closure of the aperture in such way that the aperture remains closed in its resting state, may be readily pulled open by a user at the user's election and is predisposed to returning to its closed resting state when not actively manipulated by a user.

BRIEF SUMMARY OF THE INVENTION

In broad terms, the present invention (the "Invention") is a pullover-style shirt to be worn by a user, the shirt comprising a first exterior layer of fabric, a second interior layer of fabric, an aperture in the first exterior layer of fabric, securing means that serve to close the aperture when the aperture is not actively manipulated by a user, but allow the easy opening of the aperture to display the second interior layer of fabric when the aperture is actively manipulated by a user. More precisely, the inventor expressly contemplates that the interior layer of fabric should bear a graphic display that is exposed when the aperture is opened. Still further, the inventor expressly contemplates that the securing means are to be a system of opposite polarity magnets that attract one another sewn into the edges of the aperture, thus closing the aperture via their force of attraction when not restrained from one another. Still further, the inventor expressly contemplates that the aperture should be positioned so as to locate over the sternum of a user when the pullover top is worn.

It is worth noting that the inventor readily envisions alternative preferred embodiments of the Invention, including without limitation a first preferred embodiment in which the first exterior layer of fabric and the second interior layer of fabric are integrated with each other via sewing or other means affixing the two layers to one another, and a second preferred embodiment in which the first exterior layer of fabric and the second interior layer of fabric are not integrated, but rather, worn separately, but in tandem, to collectively comprise the inventive pullover top.

BRIEF DESCRIPTION OF THE SEVERAL VIEWS OF THE DRAWING(S)

DETAILED DESCRIPTION OF THE INVENTION

Referring now to the Invention in further detail, the inventor expressly contemplates a dynamic pullover top to be worn by a user, the pullover top comprising two fabric layers including a first exterior fabric layer and a second interior fabric layer adorned with a graphic, design or message, at least a single aperture in the exterior fabric layer, and securing means integrated with the edges of the aperture that secure the aperture in a closed configuration when at rest, but which allow easy opening of the aperture when actively manipulated by a user. In practice, the aperture may be opened by active manipulation of the securing means by a user, but otherwise, the securing means revert to a resting state in which the aperture is closed. Thus, when the user actively manipulates the securing means, the second interior fabric layer is exposed and the graphic, design or message thereon is displayed, however, the aperture is in a closed configuration when at rest and the second interior fabric layer and its design, graphic or message is concealed. More specifically, the contemplated best mode of the Invention is the pullover top, as described above, wherein the securing means comprises a system of magnet pairings integrated within the edges of the aperture, the paired magnets attracting one another via their opposite poles and closing the aperture when not actively manipulated by a user. In this sense, the user may quickly obscure a graphic, display or message adorning the first exterior fabric layer and, at the same time, display a graphic, design or message adorning the second interior fabric layer by pulling the opposite poles of the paired magnets apart from one another. When the user releases any two paired magnets, the opposite poles of the two magnets attract and automatically return the aperture in the first exterior fabric layer to a closed configuration without the need of further manipulation by a user. The inventor has further contemplated that certain effects of the graphic design upon the second interior fabric layer may be accentuated by the composition of the interior fabric layer from a fabric having a notable degree of elasticity, a lycra or other polyester-based fabric being expressly contemplated. Still further, the inventor contemplates the best mode of the now identified Invention featuring the aperture in such location as to be located over the sternum of a user when the pullover top is actually worn.

Figure 1:
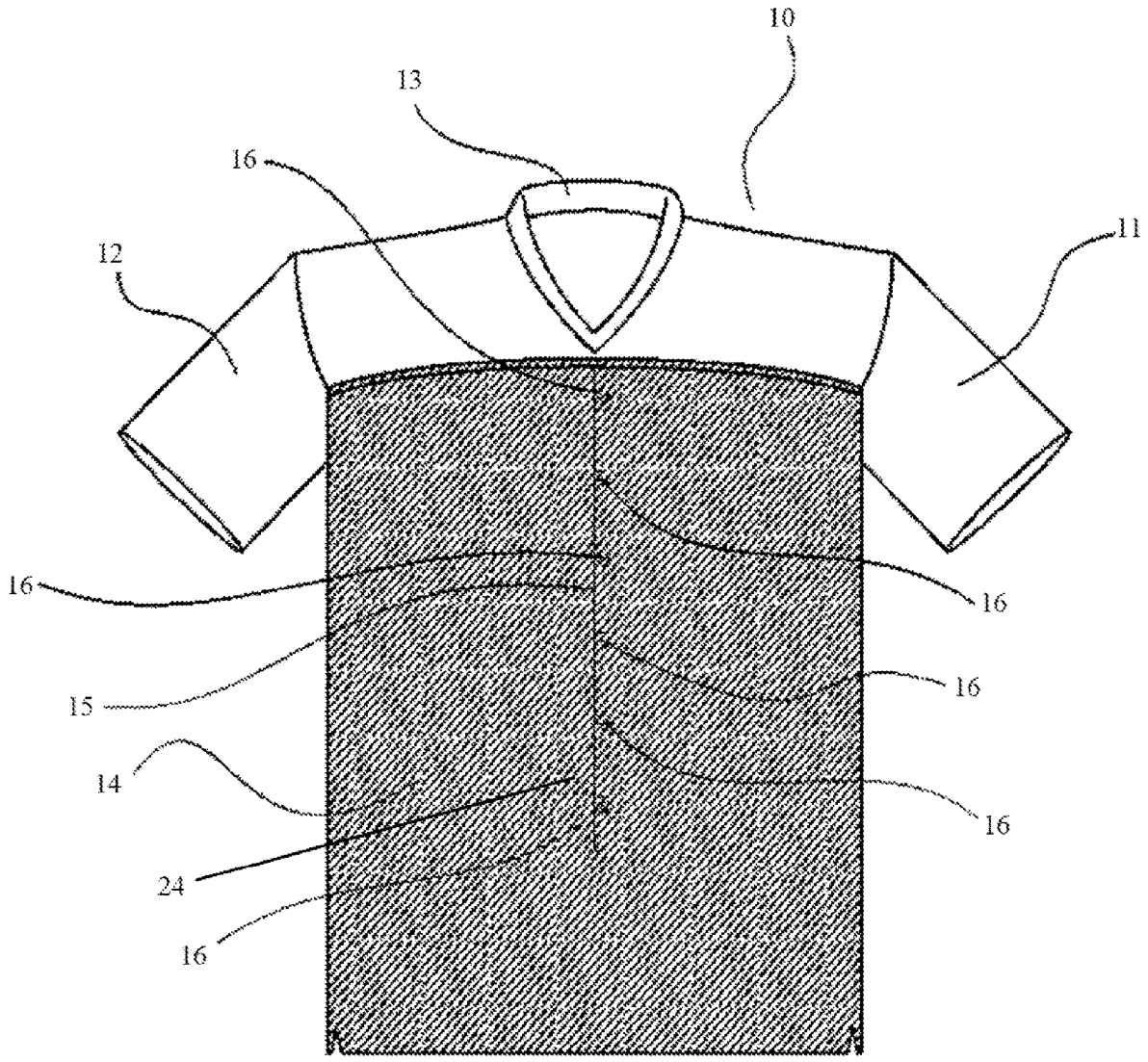
FIG. 1 is a front view of the best mode of the present invention in a first configuration.

Referring now to the invention in more detail, in FIG. 1 there is shown the inventive dynamic pullover top 10 to be worn by a user, the pullover top having the standard features one would expect in a common top of the same styling, including without limitation a right sleeve 11, a left sleeve 12, a closed collar 13, and a portion covering the shoulders and torso of a user. An unusual aspect of the now disclosed pullover top 10 is the duality of fabric layers from which it is constructed including a first exterior fabric layer 14 and a second interior fabric layer (not shown in FIG. 1). Notably, the first exterior fabric layer 14 is depicted having an aperture 15 running vertically down the chest-covering portion of the first exterior fabric layer 14. As depicted, the aperture 15, which is part of placket 24, in the first exterior fabric layer 14 is in a "closed" configuration, being secured in that configuration by a plurality of securing magnet pairings 16, each magnet pairing 16 comprising at least two magnets having opposite poles that attract the magnets to one another, thus closing the aperture 15. In the illustration provided, the first exterior fabric layer 14 of the chest of the pullover top 10 is equipped with six magnet pairings 16 integrated with the aperture 15 in the first exterior fabric layer 14. In construction, it is contemplated that two edges of the aperture 15 will have at least one magnet sewn into the edge and paired with an equal and opposite magnet in the opposing edge of the aperture 15, forming a magnet pairing 16 when the magnetic poles attract and the aperture 15 closes. The second interior fabric layer (not shown in FIG. 1) of the pullover top 10 is not visible in FIG. 1, but is disclosed in the other illustrations provided. When the placket 24 of the exterior fabric layer is in an open configuration, an interior space of the pullover shirt is met with the opening at the bottom of the pullover shirt.

Figure 2:
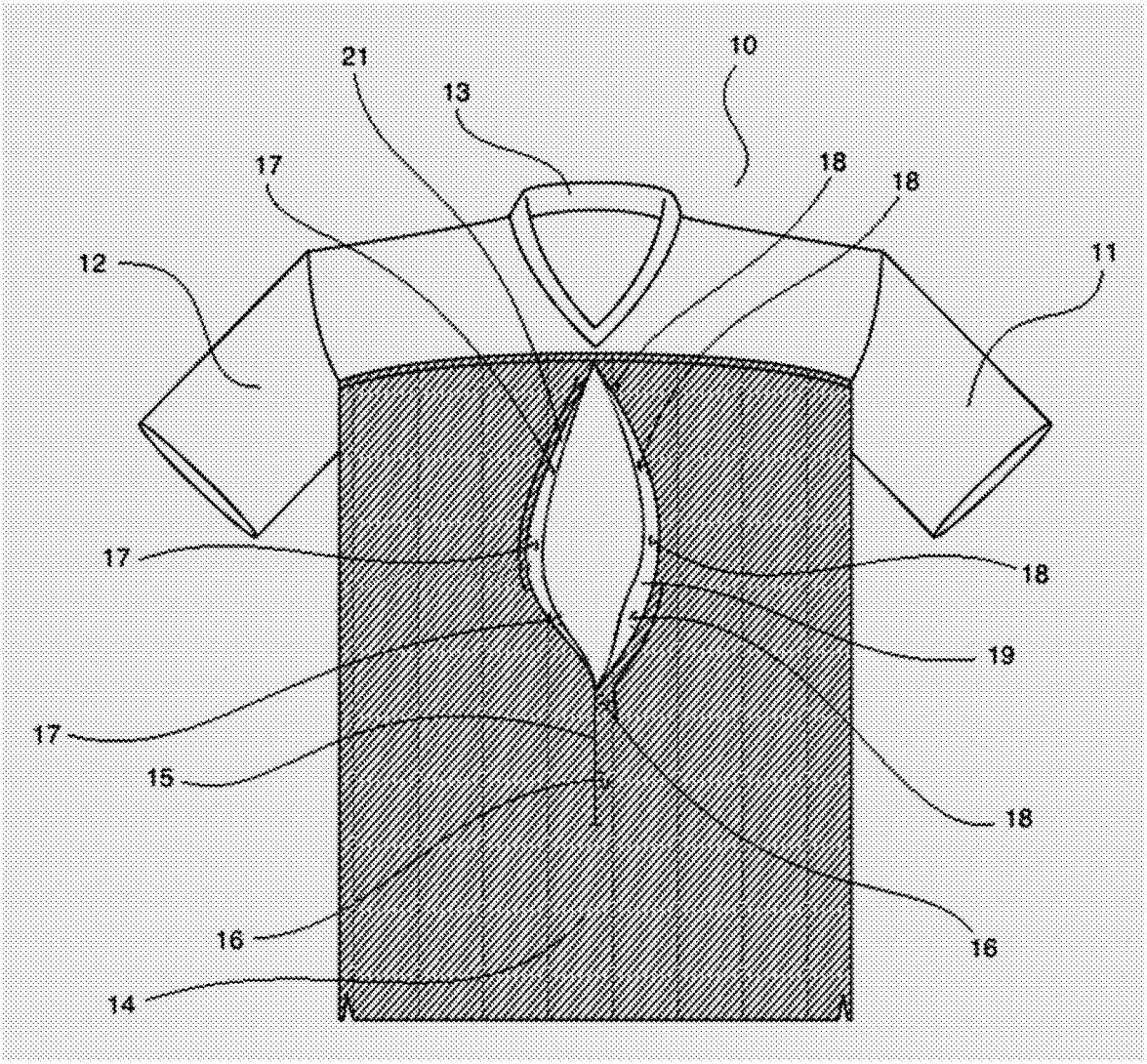
FIG. 2 is a front view of the best mode of the present invention in a second configuration.

Referring now to the invention in more detail, in FIG. 2 there is shown the inventive dynamic pullover top 10, again having the standard attributes of a common top of the same styling, including without limitation a right sleeve 11, a left sleeve 12, a closed collar 13, and a portion covering the shoulders and torso of a user. Again and shown in more detail in FIG. 2, an unusual aspect of the now disclosed pullover top 10 is the duality of fabric layers from which it is constructed including a first exterior fabric layer 14 and a second interior fabric layer 20. Again in FIG. 2, the first exterior fabric layer 14 is shown having an aperture 15 running vertically down the chest of the pullover top 10, however, in this view, the aperture 15 is depicted in an "open" configuration, so that the second interior fabric layer 20, a left edge 21 of the aperture 15, and a right edge 19 of the aperture 15 are exposed. Because the left edge 21 and the right edge 19 of the aperture 15 are exposed in FIG. 2, also exposed are both closed magnet pairings 16 and open magnet pairings 16, the open magnet pairings 16 being now visible in their constituent left magnets 17 sewn into the left edge 21 of the aperture 15, and their constituent right magnets 18 sewn into the right edge 19 of the aperture 15 in the first exterior fabric layer 14. While the second interior fabric layer 20, as depicted, does not have any graphic, design or aesthetic to speak of in the depicted pullover top 10, the inventor expressly contemplates that the surface of the second interior fabric layer 20 that is exposed when the aperture 15 is in an "open" configuration may have any number of graphic designs, prints, or messages applied to its surface visible within the "open" aperture 15.

Figure 3:
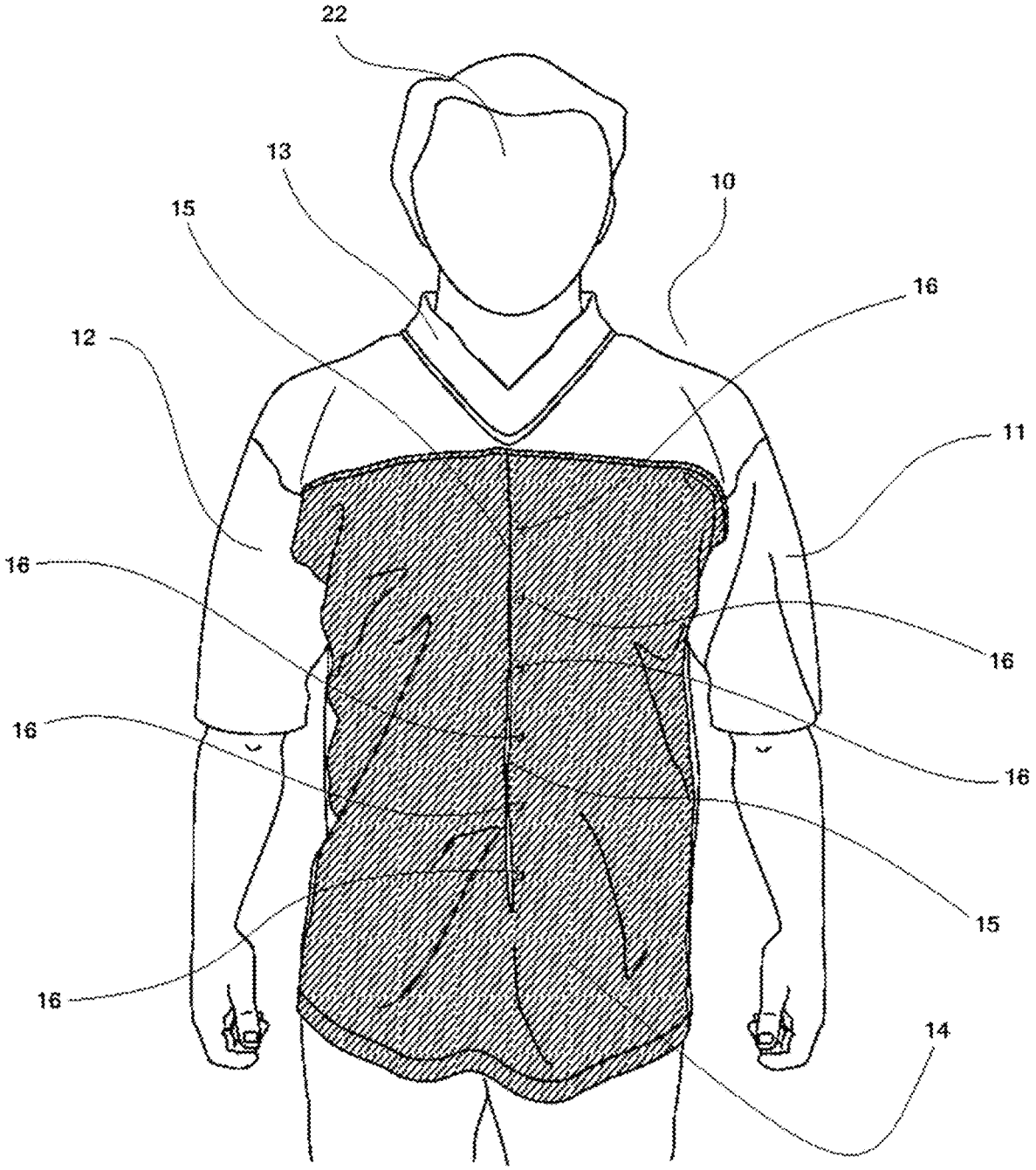
FIG. 3 is a front view of the best mode of the present invention in the first configuration when being worn by a user.

Referring now to the invention in more detail, in FIG. 3 there is shown the inventive dynamic pullover top 10 in a depiction of how it might look when worn by a user 22. Again depicted are the attributes of all commonly styled tops, including without limitation a right sleeve 11 around the right arm of the user 22, a left sleeve 12 around the left arm of the user 22, a collar 13 about the neck of the user 22, and a portion completely covering the torso of the user 22. As in FIG. 1, the pullover top 10 as shown in FIG. 3 is depicted in its "closed" configuration, with the aperture 15 in the first exterior fabric layer 14 located vertically down the sternum of the user 22 in a configuration where all magnet pairings 16 are in tact in the resting position, thereby securing the right edge (not shown in FIG. 3) of the aperture 15 to the left edge (not shown in FIG. 3) of the aperture 15 and concealing the second interior fabric layer (not shown in FIG. 3). As can be appreciated from the illustration of FIG. 3, the pullover top 10 appears very much as a typical pullover shirt in use when the aperture 15 is in its "closed" configuration and all of the magnet pairings 16 are securing the aperture 15 edges to one another.

Figure 4:
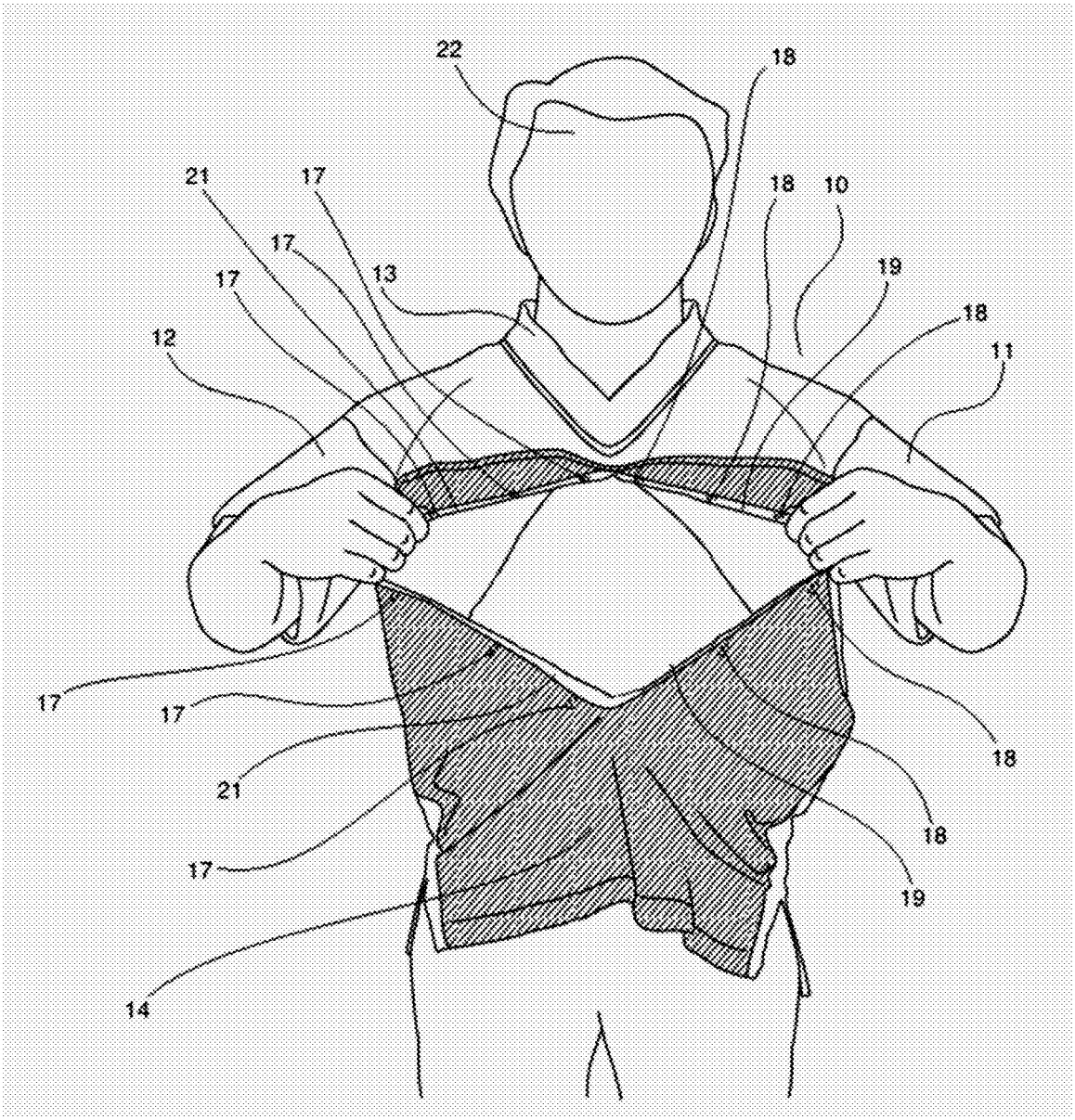
FIG. 4 is a front view of the best mode of the present invention in the second configuration when being worn by a user.

Referring now to the invention in more detail, in FIG. 4 there is shown the inventive dynamic pullover top 10 in a depiction of how it might look when worn by a user 22 with the aperture 15 in an "open" configuration. Again depicted are the attributes of all commonly styled tops, including without limitation a right sleeve 11 around the right arm of the user 22, a left sleeve 12 around the left arm of the user 22, a collar 13 about the neck of the user 22, and a portion completely covering the torso of the user 22. As in FIG. 2, the pullover top 10 as shown in FIG. 4 is depicted in its "open" configuration, with the aperture 15 in the first exterior fabric layer 14 located vertically down the sternum of the user 22 in a configuration where the paired magnets of all magnet pairings (not shown in FIG. 4) have been separated via manipulation by the user, such that the magnet pairing (not shown in FIG. 4) constituent left magnets 17 are visible as sewn into the left edge 21 of the open aperture 15, and the magnet pairing (not shown in FIG. 4) constituent right magnets 18 are visible as sewn into the right edge 19 of the open aperture 15. Again, upon manipulation of the aperture 15 by the user 22, the bonds of the magnet pairings (not shown in FIG. 4) are broken, the aperture 15 in the first exterior fabric layer 14 is opened, and the second interior fabric layer 20 is exposed. As before noted, while the second interior fabric layer 20, as depicted, does not have any graphic, design or aesthetic to speak of in the depicted pullover top 10, the inventor expressly contemplates that the surface of the second interior fabric layer 20 that is exposed when the aperture 15 is in an "open" configuration may have any number of graphic designs, prints, or messages applied to its surface visible within the "open" aperture 15.

Figure 5:
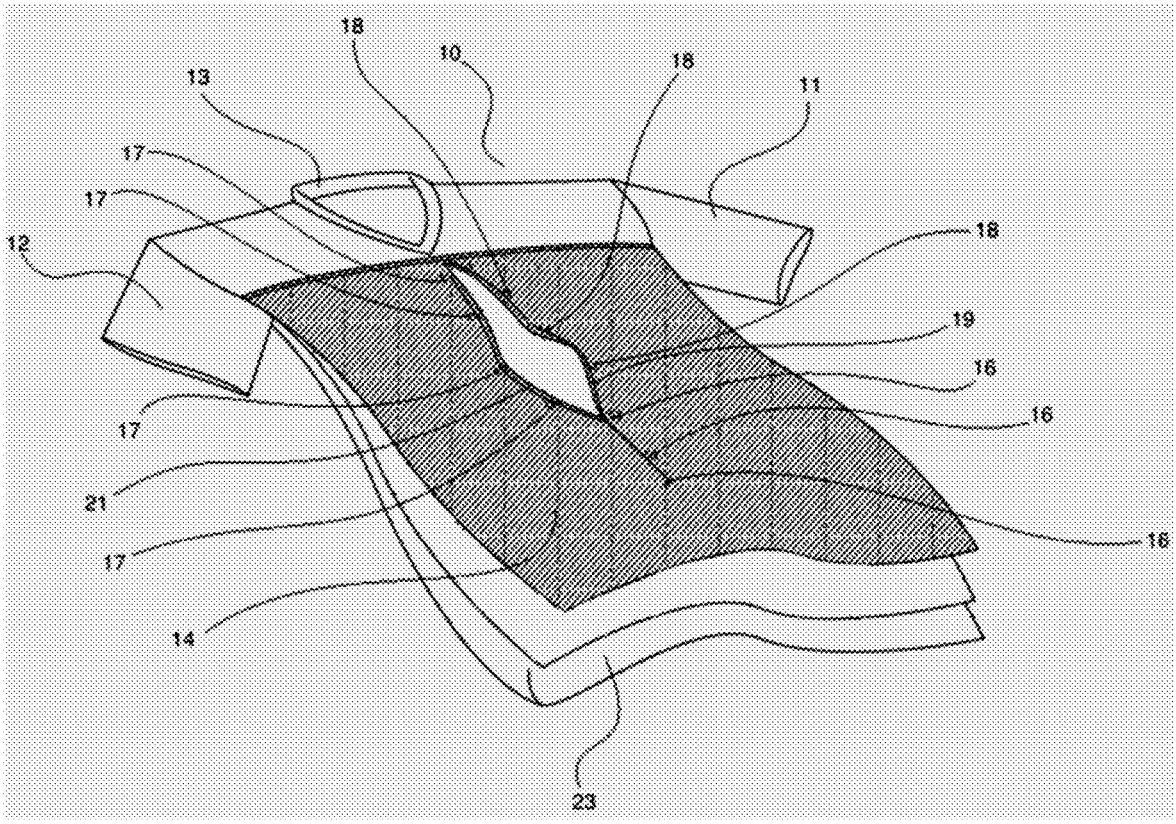
FIG. 5 is a blown-apart view of the best mode of the present invention illustrating the composition of the total Invention.

Referring now to the invention in more detail, in FIG. 5 there is shown the inventive dynamic pullover top 10 in a blown-apart view for the purpose of conveying a better appreciation of its individualized component parts. As in FIGS. 1-4, there is shown a standard pullover top 10, having a standard right sleeve 11, a standard left sleeve 12, a standard closed collar 13, and a standard portion to completely cover the torso having a front and a back 23. As depicted, the pullover top 10 is in a partially "open" configuration, the aperture 15 in the first exterior fabric layer of the top 10 being such that some magnet pairings 16 remain secure, while others have been pulled apart into their constituent left magnet 17 and constituent right magnet 18, thus allowing the "opening" of the aperture 15. Again the magnet pairing 16 constituent left magnet 17 is shown as sewn into the left edge 21 of the aperture 15, and the constituent right magnet 18 is shown as sewn into the right edge 19 of the aperture 15. As visible through both the open aperture 15 and as visible as a part of the blown-apart view itself, the second interior fabric layer 20 lies beneath the first exterior fabric layer 14, and is exposed when the aperture 15 is opened. Of particular note in this blown apart view is that the overall novelty of the pullover top 10 as shown may be alternatively achieved by either a first exterior fabric layer 14 and second interior fabric layer 20 that are integrated with one another via sewing, serging or the like, or by a standalone first exterior fabric layer 14 and a standalone second interior fabric layer 20. The important aspect of the inventive pullover 10 is that the second interior fabric layer 20 be concealed when the aperture 15 in the first exterior fabric layer 14 is "closed", and that the second interior fabric layer 20 be exposed when the aperture 15 in the first exterior fabric layer 14 is "open".

In terms of construction, the inventor contemplates that the pullover top 10 be constructed such that the first exterior fabric layer 14 is constructed of some fabric or composite fabric commonly used in the manufacture of shirts, specifically including without limitation any fabric selected from the class of cotton, polyester, lycra and/or rayon. Likewise, the inventor contemplates that the second interior fabric layer 20 of the pullover top 10 be constructed from some fabric or composite fabric commonly used in the manufacture of shirts, specifically including without limitation any fabric selected from the class of cotton, polyester, lycra and/or rayon, however, the inventor expressly contemplates that there is added utility in selecting a lycra or polyester composite construction for the second interior fabric layer 20 due to the superior abilities of polyester and lycra in accepting screen-printed graphics in such durable and vibrant colors. Any number of graphics would be appropriate to adorn the surface of the second interior fabric layer 20, though the inventor expressly contemplates a Superman "S" shield graphic, a heart graphic, or specific messages. The use of an elastic fabric such as polyester or lycra is further thought to be advantageous to allow the stretching of the second interior fabric layer 20 when a user 22 rips open the aperture 15 in the first exterior fabric layer 14 to display the graphic adorning the second interior fabric layer 20 in the context where the second interior fabric layer 20 and the first exterior fabric layer 14 are integrated and, therefore, the ripping open of the aperture 15 may strain both layers of fabric.

In terms of the securing means, the inventor has consciously selected the aforementioned magnet pairing 16 system to secure the aperture 15 closed due to the ability of the opposite polarity left magnet 17 and right magnet 18 to attract one another and, therefore, automatically close the aperture 15 when left at rest by a user 22. To the inventor's knowledge no other securing system or fastening system has the ability to discretely "close itself" and thus preserve the novelty of the novelty inventive pullover top 10 until such time as a user 22 chooses to disclose the novelty of the aperture 15 to a viewing audience. For this reason, the magnet pairings 16 are referred to herein and throughout as a "securing means" or "securing system" because it is expressly contemplated by the inventor that there utility in the context of the disclosed pullover 10 exceeds that of any commonly known fasteners, including without limitation zippers, snap-fasteners, and/or hoop and loop assemblies. The inventor also acknowledges that the crude functionality of the now disclosed pullover could also be attained through the use of commonly known fasteners, including without limitation zippers, snap-fasteners, and/or hoop and loop assemblies.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

For example, although the inventor identifies securing means throughout this specification and notes that the best mode securing means are likely to comprise a system of magnets, the inventor further appreciates that the securing of the aperture contemplated may also be accomplished by fastening means, and may include any of a host of options, including but not limited to zippers, snap-together button assemblies, and/or hook and loop fastening systems such as Velcro®. Likewise and as previously mentioned, the inventor expressly contemplates that embodiments may exist where the exterior and interior fabric layers are either affixed to one another or exist as separate and distinct components.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above-described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A garment;

the garment consisting of: a pullover shirt: the pullover shirt consisting of:

a front side of the pullover shirt, a back side of the pullover shirt, a top of the pullover shirt, a bottom of the pullover shirt, a torso opening at the bottom of the pullover shirt, a secondary opening at the bottom of the pullover shirt, a closed V-shaped collar circumscribing a V-shaped neck hole, a left sleeve circumscribing a left arm hole, and a right sleeve circumscribing a right arm hole; and the front side of the pullover shirt having: a first single exterior fabric layer, a single interior fabric layer, a first half of the closed V-shaped collar, and a placket; and the back side of the pullover shirt having: a second single exterior fabric layer, a second half of the closed V-shaped collar; and the back side of the pullover shirt connected to the front side of the pullover shirt at a left side of the pullover shirt and at a right side of the pullover shirt thereby creating the torso opening at the bottom of the pullover shirt; and the left side of the pullover shirt containing the left sleeve circumscribing the left arm hole, and the right side of the pullover shirt containing the right sleeve circumscribing the right arm hole; the left side of the pullover shirt having a first slit extending vertically from the bottom of the pullover shirt along a center of the left side of the pullover shirt, and the right side of the pullover shirt having a second slit extending vertically from the bottom of the pullover shirt along a center of the right side of the pullover shirt; and the single interior fabric layer being situated between an inner surface of the first single exterior fabric layer and an inner surface of a second single exterior fabric layer; the single interior fabric layer being physically adhered to the first single exterior fabric layer and thereby creating the secondary opening at the bottom of the shirt; and the placket having a single linear aperture located centrally on the first single exterior fabric layer and extending vertically between the V-shaped collar and the bottom of the pullover shirt; and the single linear aperture having: a first edge containing a top first edge end and a bottom first edge end, a second edge containing a top second edge end and a bottom second edge end, a proximal termination point, and a distal termination point; wherein the first edge opposes the second edge; and the single linear aperture is created by the top first edge end and the top second edge end converging at the proximal termination point, and the bottom first edge end and the bottom second edge end converging at the distal termination point; and the proximal termination point terminates before the closed V-shaped neck collar and the distal termination point terminates before the bottom of the pullover shirt; and wherein the first edge and the second edge each contain a total of twelve evenly spaced magnets; the first edge containing a first half of the twelve evenly spaced magnets, and the second edge containing a second half of the twelve evenly spaced magnets; and the single interior fabric layer being configured to be partially visible when the placket is in an open state; and the single interior fabric layer being configured to not be visible when the placket is in a closed state.

* * * * *